US006209268B1

(12) United States Patent
Schmidt

(10) Patent No.: US 6,209,268 B1
(45) Date of Patent: Apr. 3, 2001

(54) OVERHANG SUPPORT SYSTEM FOR GABLE ROOFS

(76) Inventor: Dwight M. Schmidt, 19022 N. 71st Dr., Glendale, AZ (US) 85308

( * ) Notice: Subject to any disclaimer, the term of this patent is extended or adjusted under 35 U.S.C. 154(b) by 0 days.

(21) Appl. No.: 09/251,272

(22) Filed: Feb. 16, 1999

Related U.S. Application Data

(63) Continuation-in-part of application No. 08/792,779, filed on Mar. 3, 1997, now abandoned, which is a continuation-in-part of application No. 08/715,048, filed on Sep. 17, 1996, now abandoned.

(51) Int. Cl.[7] ..... F04B 7/04

(52) U.S. Cl. ..... 52/92.1; 52/92.2; 52/92.3; 52/93.2; 52/7.2; 52/7.5; 52/665

(58) Field of Search ..... 52/92.1, 92.2, 52/92.3, 93.2, 702, 712, 713, 715, 763, 665; 403/4, 231, 232.1, 233, 263, 396, 391, 403, 382

(56) References Cited

U.S. PATENT DOCUMENTS 2,611,160 * 9/1952 Hanesse ..... 52/665
3,256,030 * 6/1966 Banse .
3,333,875 * 8/1967 Tracy .
3,420,019 * 1/1969 Padilla ..... 52/665
3,740,084 * 6/1973 Tellberg ..... 287/20.927
3,787,130 * 1/1974 Hemmings et al. ..... 52/665 X
5,150,982 * 9/1992 Gilb ..... 403/232.1
5,349,800 * 9/1994 Peng ..... 52/665 X
5,660,005 * 8/1997 Tacoma ..... 52/93.2
5,697,725 * 12/1997 Ballash et al. ..... 403/231

* cited by examiner

*Primary Examiner*—Carl D. Friedman
*Assistant Examiner*—Phi Dieu Tran A
(74) *Attorney, Agent, or Firm*—Martin L. Stoneman

(57) ABSTRACT

This invention provides an overhang support system for gable roofs which eliminates any need to put a notch in the gable end truss top chord member. It utilizes a novel unitary connector device for improved support of overhang structures in a gable roof of the type including an overhang member, a gable end truss top chord member, and a first adjacent truss (to the end truss) top chord member. The rigid connector provides some holes for nailing to an intermediate support member, situated between the first adjacent truss top chord member and the gable end truss top chord member, or, optionally, in one preferred embodiment, if no intermediate support member is used, these holes are used for nailing to an overhang support member; and it provides some holes for nailing to an overhang support member, situated between the gable end truss top chord member and the overhang member; and also holes for nailing to the gable end truss top chord member. The connector is channel-shaped to fit snugly over, e.g., the overhang support member; and the connector enhances the strength of cantilever support of the overhang support member.

18 Claims, 7 Drawing Sheets

43
37
46
40
33
45
48
41
52
5
6
51
47
26

67
45
62
65
55
41
64
71
47
40
33

54
66
65
56
64
60
45

61
FASCIA (BARGE)
62
53
55
63

46
53
71
45
56
65
67
64
62
66
47
55
41
33
40

FIG. 7
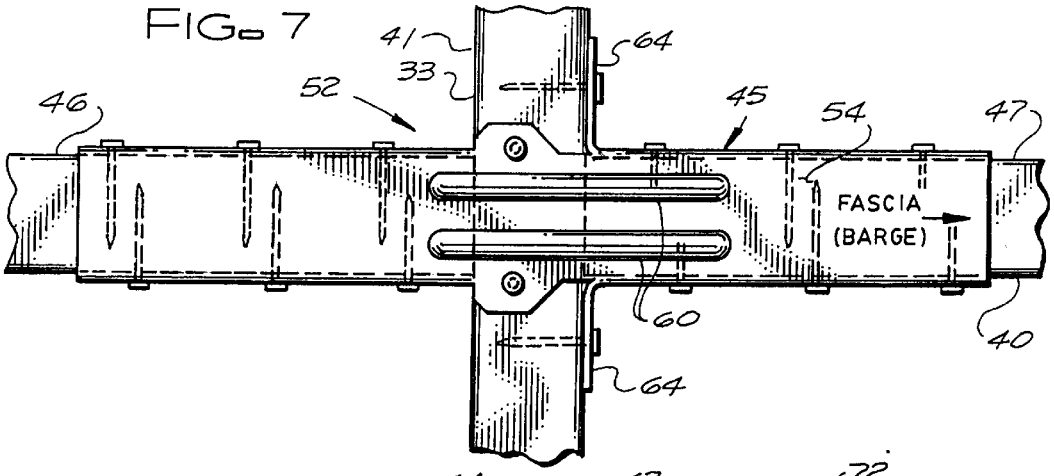
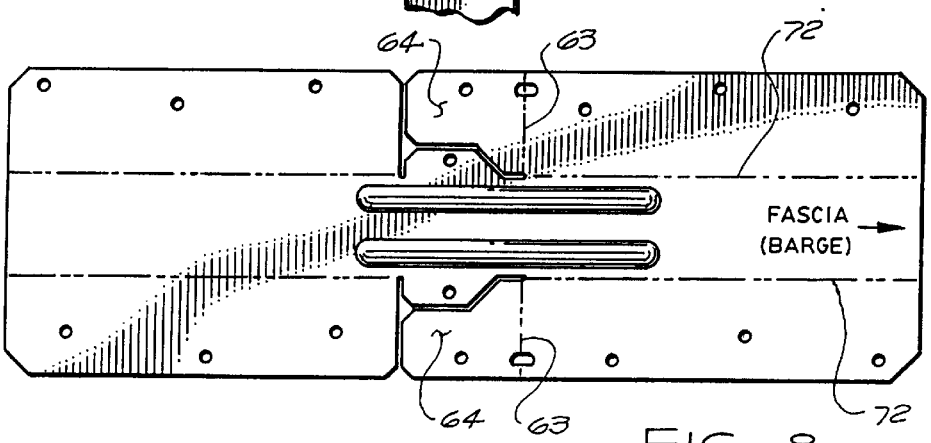
FIG. 8
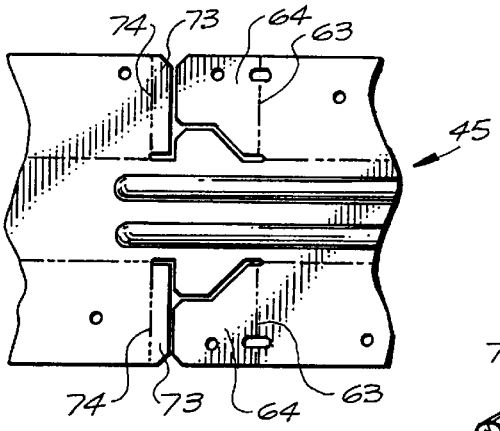
FIG. 9
FIG. 10
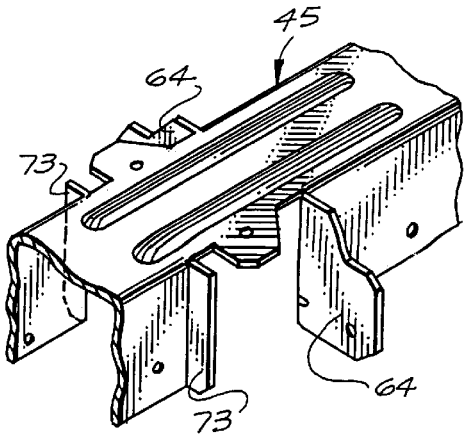

FIG. 11
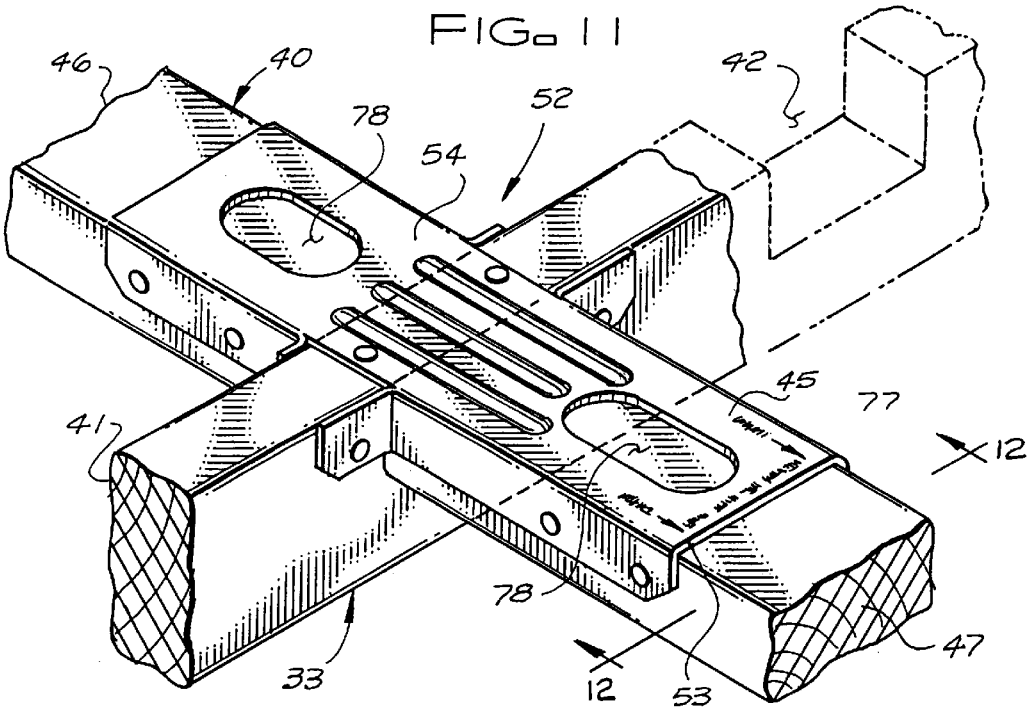
FIG. 12
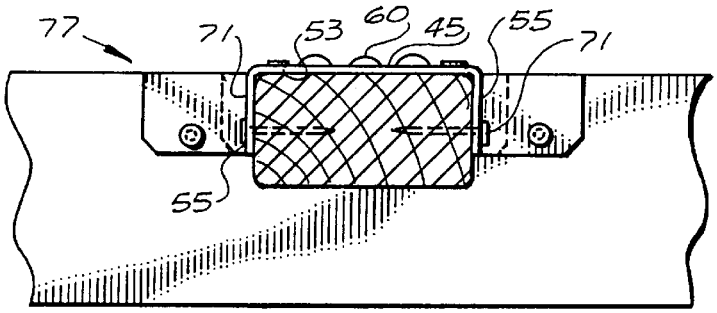
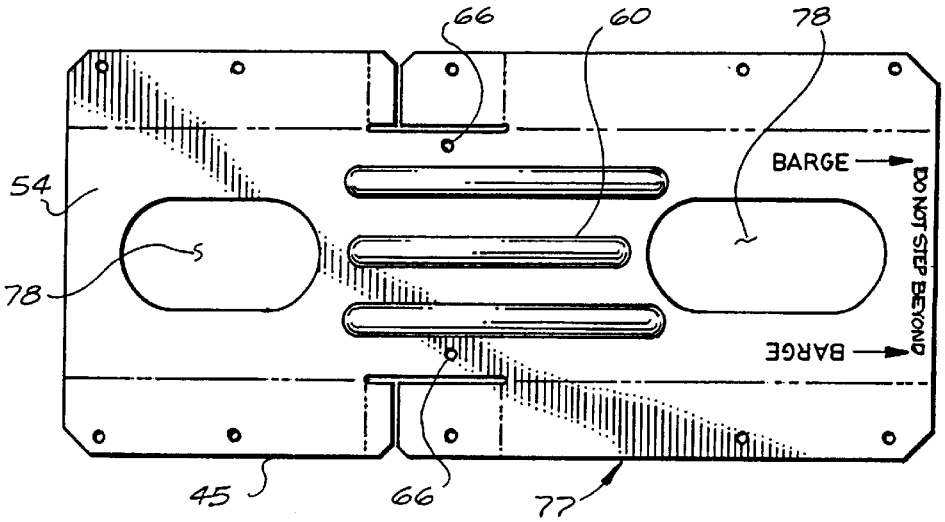
FIG. 13

FIG. 17
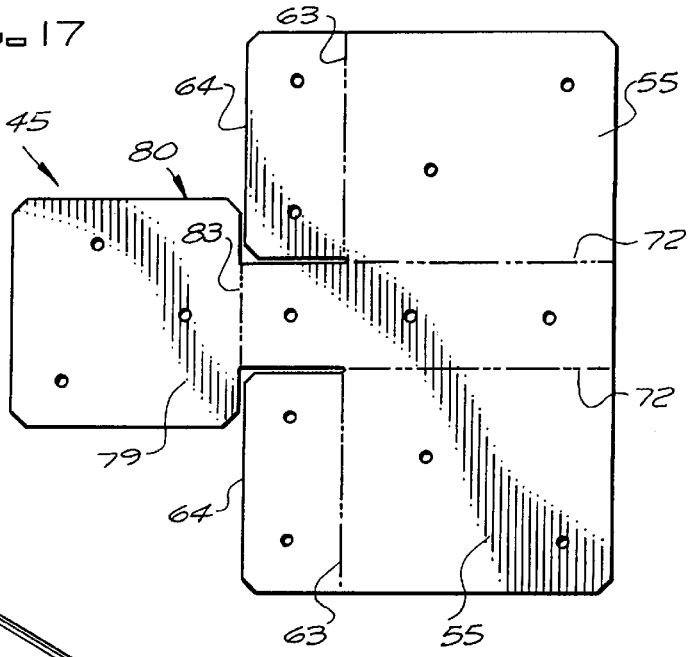
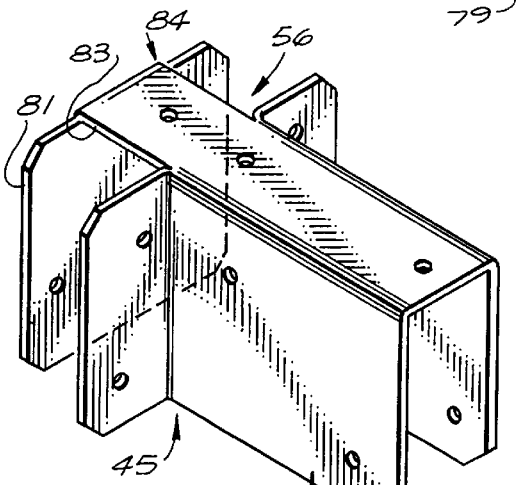
FIG. 18
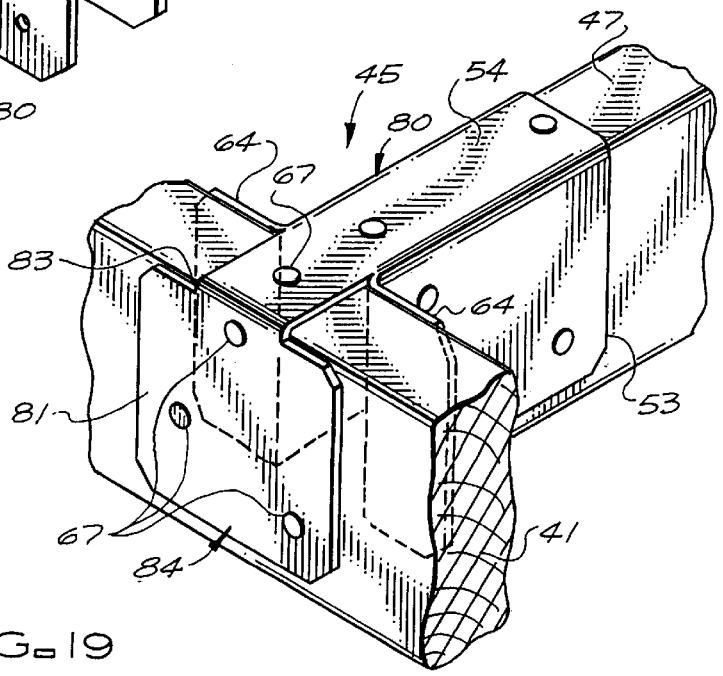
FIG. 19

OVERHANG SUPPORT SYSTEM FOR GABLE ROOFS

This application is a continuation-in-part of application Ser. No. 08/792,779, filed Mar. 3, 1997, now abandoned in favor of this application, which is a continuation-in-part of application Ser. No. 08/715,048, filed Sep. 17, 1996, now abandoned.

BACKGROUND OF THE INVENTION

1. Field of the Invention

This invention relates to providing an overhang support system for gable roofs. More particularly, this invention concerns such a system utilizing a novel connector device for improved cantilever support of overhang structures as well as improved resistance against uplift forces, such as wind.

2. Description of the Prior Art

The typical prior art systems for providing an overhang support system for gable roofs are described and illustrated (see FIG. 1 and FIG. 2) in connection with the detailed description hereinafter of this invention. Such prior-art systems, as further hereinafter particularized, either fail to provide strong enough support for gable roof overhang members or create new structural problems in providing such support. For example, one typical method used to provide support for gable roof overhang members is to provide a plurality of unitary overhang support members extending from the top chord of the first adjacent roof truss, bisecting the gable end truss, and continuing outward to the overhang members. To provide a roof with a uniform slope, it is necessary to cut notches in either the gable end truss, the overhang support members, or both at the point where the unitary overhang support members bisect the gable end truss. Requiring the notching of one or more members is not only difficult, costly and time consuming, it also produces stress concentration sites at the notch points thereby decreasing the effective load bearing strength of the notched members.

Applicant is aware of other prior art attempts to make more rigid the connection points of various structural members. For example, U.S. Pat. No. 5,150,982 issued to Gilb discloses a deck post tie for use in resisting overturning bending moments produced in an upright structural member. To provide structural resistance to possible bending moments, the Gilb apparatus teaches a tie in which the top surface is not flush with the adjacent surface of the support member, but rather has a gradual slope which increases in the direction of maximum bending moment (e.g., bottom of upright support member). Though the Gilb apparatus may be adequate for its intended purpose, it would be inadequate for the purposes of the present disclosure because the sloped top surface, though necessary to counteract bending moments when used in accordance with the Gilb disclosure, would produce a roof having a non-uniform slope. Thus, it is believed by the applicant that the prior art cited herein will not accomplish the purpose of the present invention.

OBJECTS OF THE INVENTION

A primary object of the present invention is to fulfill the need for strong support of gable roof overhang members, without thereby creating new structural problems, by the provision of an improved overhang support system according to the present invention. A further primary object of the present invention is to provide such an improved system utilizing a unitary connector body of the present invention.

A further primary object of the present invention is to provide such a system and body which are efficient, inexpensive, and handy. Other objects of this invention will become apparent with reference to the following invention descriptions.

SUMMARY OF THE INVENTION

According to a preferred embodiment of the present invention, this invention provides, for use with an overhang support system for a gable roof of the type including an overhang member, a gable end truss top chord member, and a first adjacent truss (to such end truss) top chord member, a unitary connector body comprising: first connection means for connecting an intermediate support member, situated between such first adjacent truss top chord member and such gable end truss top chord member, to such unitary connector body; second connection means for connecting an overhang support member, situated between such gable end truss top chord member and such overhang member, to such unitary connector body; and third connection means for connecting such gable end truss top chord member to such unitary connector body; such unitary connector body being constructed and arranged to enhance, when connected, the strength of cantilever support of such overhang support member. This invention further provides such a unitary connector body further comprising first channel means for fitting snugly over such overhang support member. Furthermore, it provides such a unitary connector body further comprising second channel means for fitting snugly over such intermediate support member. And it provides such a unitary connector body further comprising first connector positioning means for abutting such gable end truss top chord member for providing enhanced cantilever support for such overhang support member.

Moreover, this invention provides such a unitary connector body wherein such first connector positioning means is constructed and arranged for abutting a first side of such gable end truss top chord member, such first side facing toward such overhang member. And it also provides such a unitary connector body further comprising: second connector positioning means for abutting such gable end truss top chord member for providing positioning support for such unitary connector body; wherein such second connector positioning means is constructed and arranged for abutting a second side of such gable end truss chord member, such second side facing away from such overhang member; and, also, further comprising second strengthening means, adjoining such first connector positioning means and such second connector positioning means, for enhancing the structural support against lateral bending of such unitary connector body. And the present invention provides a unitary connector body further comprising a planar portion constructed and arranged for situation adjacent a plane of an upper side of such gable end truss top chord member and elongated in a direction from such first connection means to such second connection means; and, further, wherein such elongated planar portion comprises strengthening means for enhancing the structural support against bending of such planar portion of such unitary connector body.

In addition, this invention provides such a unitary connector body wherein such first, second, and third connection means comprise hole means in such unitary connector body for receiving attaching units; and, further, wherein such attaching units comprise nails and such hole means comprises offset means for providing nailing locations for minimizing structural harm to such intermediate support member and such overhang support member. And it provides such a unitary connector body further comprising a planar portion constructed and arranged for situation adjacent a plane of an upper side of such gable end truss top chord member and elongated in a direction from such first connection means to such second connection means; and wherein: such first, second, and third connection means comprise hole means in such unitary connector body for receiving attaching units; such attaching units comprise nails; such hole means comprises offset means for providing nailing locations for minimizing structural harm to any nailed members; and such channel means is constructed and arranged to fit snugly over the "2" width of a 2× member.

Yet additionally, this invention provides, according to preferred embodiment thereof, such a unitary connector body wherein said first connection means is constructed and arranged to provide user option: for connecting an intermediate support member, situated between said first adjacent truss top chord member and said gable end truss top chord member, to said unitary connector body; or for connecting said gable end truss top chord member to said unitary connector body. And it provides such a unitary connector body wherein: said first connection means comprises a bendable portion constructed and arranged in such manner as to provide, when said bendable portion is not bent, an attachment means for connecting an intermediate support member, situated between said first adjacent truss top chord member and said gable end truss top chord member, to said unitary connector body, and, when said bendable portion is bent, at about 90 degrees, an attachment means for connecting said gable end truss top chord member to said unitary connector body.

Even further, this invention provides, in accordance with a preferred embodiment thereof, an overhang support system, for a gable roof, comprising: a gable end truss top chord member; a first adjacent truss (to such end truss) top chord member; an overhang member; an overhang support member, situated between and abutting such gable end truss top chord member and such overhang member; and a unitary connector body comprising: second connection means for connecting such overhang support member to such unitary connector body; and third connection means for connecting such gable end truss top chord member to such unitary connector body; such unitary connector body being constructed and arranged to enhance, when connected, the strength of cantilever support of such overhang support member. And, it provides such an overhang support system further comprising: an intermediate support member, situated between and abutting such first adjacent truss top chord member and such gable end truss top chord member; wherein such unitary connector body further comprises first connection means for connecting such intermediate support member to such unitary connector body. And it provides such an overhang support system wherein such unitary connector body further comprises channel means for fitting snugly over such intermediate support member and such overhang support member; and, further, wherein such unitary connector body further comprises first connector positioning means abutting such gable end truss top chord member for providing enhanced cantilever support for such overhang support member, wherein such first connector positioning means abuts a first side of such gable end truss top chord member, such first side facing toward such overhang member.

Even additionally, this invention provides such an overhang support system wherein such unitary connector body further comprises second connector positioning means abutting such gable end truss top chord member for providing positioning support for such unitary connector body, wherein such second connector positioning means abuts a second side of such gable end truss chord member, such second side facing away from such overhang member. Also, it provides such an overhang support system wherein such unitary connector body further comprises a planar portion constructed and arranged for situation adjacent a plane of an upper side of such gable end truss top chord member and elongated in a direction from such first connection means to such second connection means, wherein such elongated planar portion comprises strengthening means for enhancing the structural support against bending of such planar portion of such unitary connector body. And it provides such an overhang support system wherein such strengthening means comprises a longitudinal rib raised from such plane.

Yet further, in accordance with a preferred embodiment thereof, the present invention provides, for use with an overhang support system for a gable roof of the type including an overhang member, a unitary gable end truss top chord member, and a first adjacent truss (to such end truss) top chord member, a method of providing improved support to an overhang support member extending outward from such gable end truss top chord member to support such overhang member, comprising the steps of: attaching such unitary gable end truss top chord member to a rigid unitary connector body; attaching such overhang support member to such rigid unitary connector body and abutting such gable end truss top chord member; and attaching such overhang member to such overhang support member; such rigid unitary connector body being constructed and arranged to enhance the strength of cantilever support of such overhang support member. In addition, the present invention provides for such a method further comprising: attaching an intermediate support member between such unitary gable end truss top chord member and such first adjacent truss top chord member; and attaching such intermediate support member to such rigid unitary connector body.

Yet further, in accordance with a preferred embodiment thereof, the present invention provides, for use with an overhang support system for a gable roof of the type including an overhang member, a gable end truss top chord member, and a first adjacent truss (to said end truss) top chord member, a unitary connector body comprising: first connection means for use, optionally, by a user, (1) for connecting an intermediate support member, situated between said first adjacent truss top chord member and said gable end truss top chord member, to said unitary connector body, or (2) for connecting said gable end truss top chord member to said unitary connector body; second connection means for connecting an overhang support member, situated between said gable end truss top chord member and said overhang member, to said unitary connector body; and third connection means for connecting said gable end truss top chord member to said unitary connector body; said unitary connector body being constructed and arranged to enhance, when connected, the strength of cantilever support of said overhang support member. It further provides a unitary connector body wherein: said first connection means comprises a substantially-flat bendable portion constructed and arranged in such manner as to provide (1) when said bendable portion is not bent, an attachment means for connecting an intermediate support member, situated between said first adjacent truss top chord member and said gable end truss top chord member, to said unitary connector body, and (2) when said bendable portion is bent, at about 90 degrees, an attachment means for connecting said gable end truss top chord member to said unitary connector body.

Yet further, in accordance with a preferred embodiment thereof, the present invention provides, for use with an overhang support system for a gable roof of the type including an overhang member, a gable end truss top chord member, and a first adjacent truss (to such end truss) top chord member, a unitary connector body comprising: a first channel portion having a pair of opposing side walls and structured and arranged to engage an intermediate support member, situated between such first adjacent truss top chord member and such gable end truss top chord member; a second channel portion having a pair of opposing side walls and structured and arranged to engage an overhang support member, situated between such gable end truss top chord member and such overhang member; a planar portion disposed between and integrally attached to such first channel portion and such second channel portion; a first pair of nailing wings, one such wing of such first pair being attached to each of such side walls of such first channel portion and extending at an angle therefrom, such pair of first nailing wings being structured and arranged for attachment to a first side of such gable end truss top chord member; and a second pair of nailing wings, one such wing of such second pair being attached to each of such side walls of such second channel portion and extending at an angle therefrom, such pair of second nailing wings structured and arranged for attachment to a second side of such gable end truss top chord member.

Additionally, the present invention provides for such a unitary connector body further comprising a plurality of strengthening ribs substantially spanning the width of such first and second nailing wings and extending therefrom to such side walls. And, it provides for such a unitary connector body wherein such unitary connector body has longitudinal ends and has a symmetrical structure wherein such first and second channel portions are longitudinally symmetrical and essentially identical in structure; and wherein such first and second pairs of nailing wings are longitudinally symmetrical and essentially identical in structure; whereby such unitary connector body may be situated with either of such longitudinal ends facing such overhang member.

BRIEF DESCRIPTION OF THE DRAWINGS

FIG. 7 is a top plan view of a roof portion with the illustrated unitary connector body.

FIG. 8 is a top plan view of the illustrated unitary connector body prior to bending during manufacture.

FIG. 9 is a partial top plan view of a first alternate preferred embodiment of the unitary connector body of this invention prior to bending during manufacture.

FIG. 10 is a partial perspective view illustrating the first alternate preferred embodiment of the unitary connector body of this invention.

FIG. 11 is a perspective view illustrating the use of a second alternate preferred embodiment of the unitary connector body of this invention.

FIG. 12 is a cross-section elevation end view of a roof portion illustrating the use of the second alternate preferred embodiment of the unitary connector body of this invention.

FIG. 13 is a top plan view of the second alternate preferred embodiment of the unitary connector body of this invention prior to bending during manufacture.

FIG. 17 is a top plan view of the third alternate preferred embodiment of the unitary connector body of this invention prior to bending during manufacture.

FIG. 18 is a perspective view of the third alternate preferred embodiment of the unitary connector body modified for use in an alternate manner.

FIG. 19 is a perspective view of the alternate use of the third alternate preferred embodiment of the unitary connector body modified for use in the alternate manner.

DETAILED DESCRIPTION OF A PREFERRED EMBODIMENT AND THE BEST MODE OF PRACTICE

Figure 1:
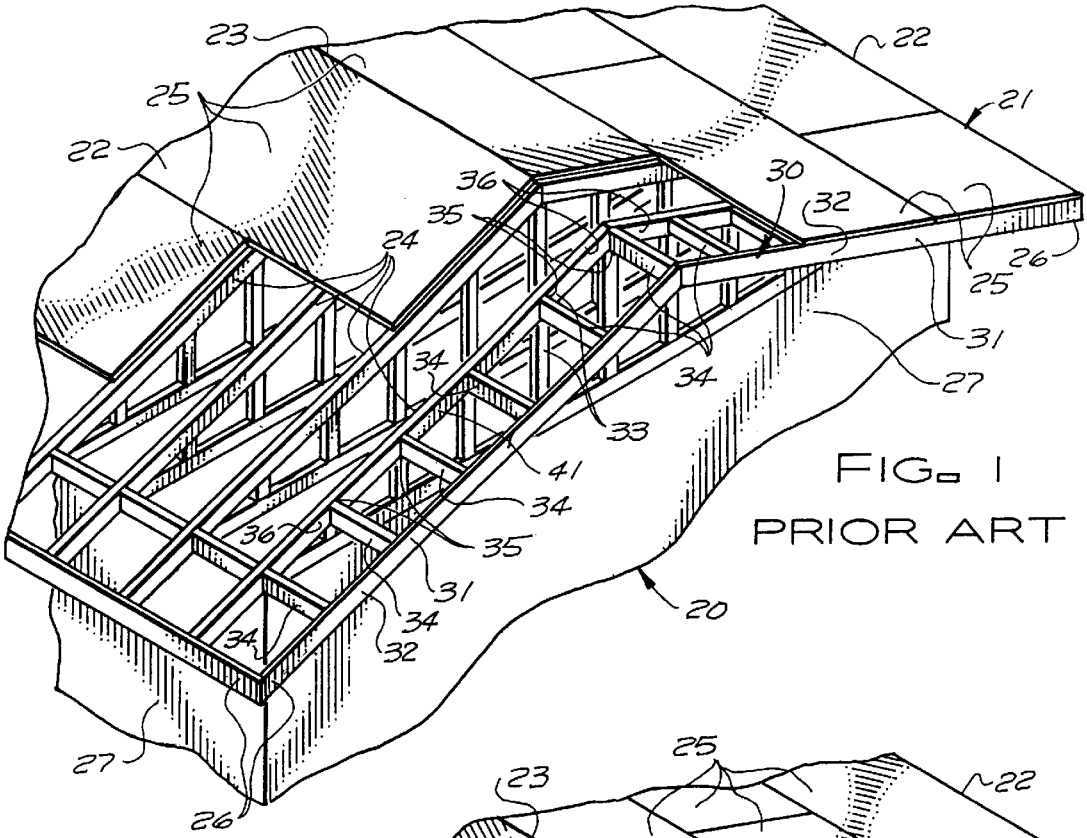
FIG. 1 PRIOR ART
FIG. 1 is a perspective view of a building roof using a first prior art system of overhang support for gable roofs.
Figure 2:
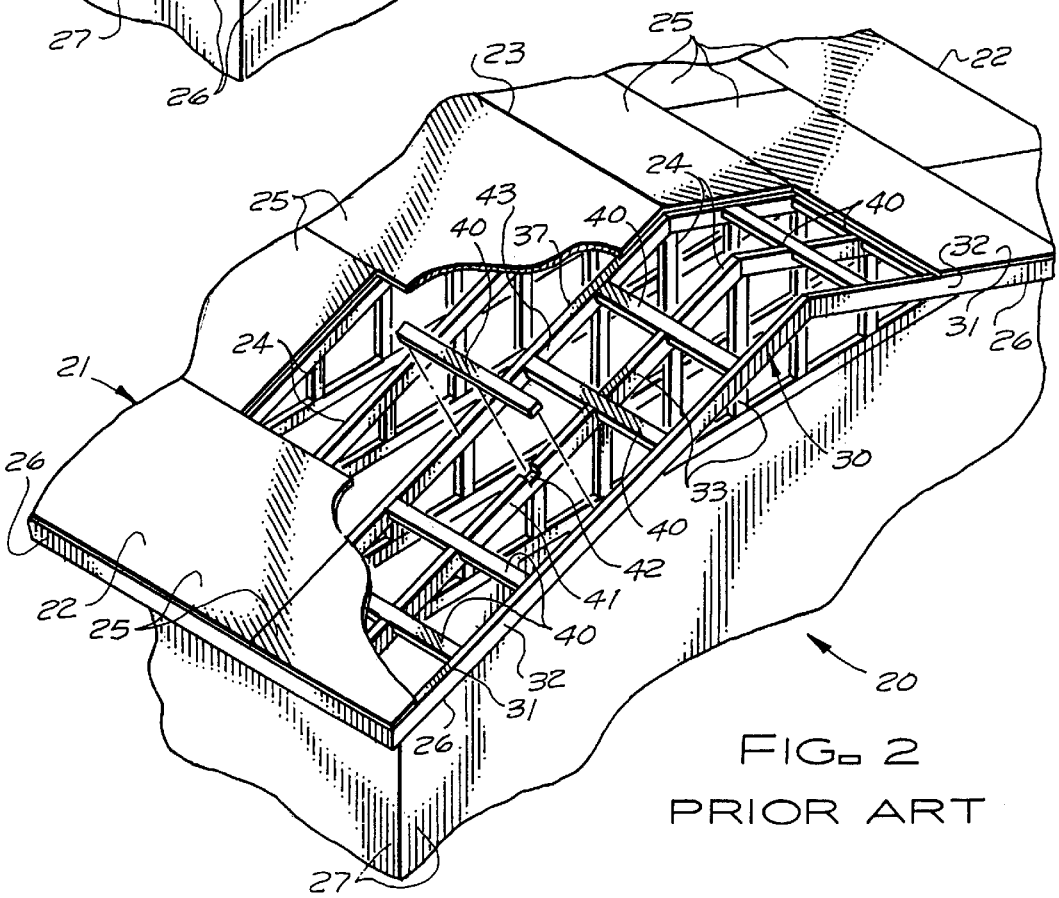
FIG. 2 PRIOR ART
FIG. 2 is a perspective view of a building roof with a second prior art system of overhang support for gable roofs.

Shown in perspective views, in FIGS. 1 and 2, are portions of buildings 20 with prior-art typical roofs 21, in the final stages of construction. The roofs 21 are of conventional and common construction, with sloping sides 22 joining at a central elevated ridge 23. The roofs 21 are typical wood construction, utilizing standard trusses 24, sheathed with plywood panels 25, and providing conventional overhang members 26 which extend outward beyond the walls 27. At the gable ends 30 of the roof 21 are the gable overhang panels 31 incorporating a fascia 32 on the outward ends. The primary structural supporting means at each gable overhang panel 31 is the gable end truss 33, which is the truss supported by an exterior wall 27 and the truss furthest outward at the gable end 30 of the roof 21. To support the gable overhang panels 31 and provide attachment for the fascia 32, additional interconnecting support structure between the gable end truss 33 and the fascia 32 is required. Without additional support structure, for example, the plywood panels 25 remain cantilevered and unsupported from the gable end truss 33 outward. With weight from the final roofing coatings and coverings, an unsupported overhang member 26 is not suitable to withstand the elements of weather and normal use.

Referring now solely to FIG. 1, a common system for providing overhang support for the gable ends 30 of a roof 21 is illustrated. Overhang support members 34 are provided from the top chord 41 of the gable end truss 33 outward and are the attachment locations for the overhang members 26 supporting the fascia 32 and the plywood panels 25 in the overhang areas. Overhang support members 34 would, for example, commonly be wood 2×4's or 2×6's or even larger (being as a group hereinafter called 2×'s), with inward ends 35 abutted against the outer surface 36 of the gable end truss 33, and nailed in place. These overhang support members 34 in the system of FIG. 1 do provide some strength and integrity to the overhang members 26, but fail to provide sufficient structural ties to the remainder of the roof 21. In essence, the roof 21 can bend at the point of the gable end truss 33, allowing the overhang members 26 (with the gable overhang panels 31 with the fascia 32) and overhang support members 34 to droop downward. This bending or drooping may be in connection with twisting of the gable end truss 33 and/or separation of the nailed connections of the overhang support members 34 to the gable end truss 33, which separation would also permit undesired uplifting of the overhang members, as by wind.

If the overhang support members 34 were to be further extended inward into the roof structure, past the gable end truss 33, and tieing into the first adjacent roof truss 37 (to the gable end truss 33), drooping of the overhang members 26 can be minimized or eliminated. This method of construction is illustrated in FIG. 2 and is commonly used in roof construction. Extended overhang supports 40 extend from the top chord 43 of the first adjacent roof truss 37 to the gable end truss 33 and outward to the overhang members 26. The twisting forces acting on the gable end truss 33 are thereby minimized or eliminated and the overhang members 26 receive greater structural support. The extended roof supports 40 are butted and nailed to the top chord 43 of the first adjacent roof truss 37, but as they extend outward to overhang members 26, they pass over and are supported by the gable end truss 33, but they spatially interfere with the top of the top chord 41 of the gable end truss 33. To accommodate this interference with the extended roof supports 40, the top chord 41 of the gable end truss 33 is cut into, forming a notch 42 at each point where the extended roof supports 40 are located. The extended roof supports 40 may then extend unobstructed from the first adjacent roof truss 37 outward to the overhang members 26. Although the gable overhang panels 31 now receive improved structural support, new problems are encountered. The notches 42 cut deeply into the top chord 41 of the gable end truss 33, greatly reducing its strength. If the top chord 41 and extended roof supports 40 are both 2×4's, and the extended roof supports 40 are positioned on their sides for minimum notch 42 depth requirements, the notch 42 still must be cut about half way through the height of the top chord 41 of the gable end truss 33. Cutting notch 42 into the top chord 41 of the gable end truss 33 is also difficult, costly and time consuming; and it is no solution to the wind-uplift problem.

Figure 3:
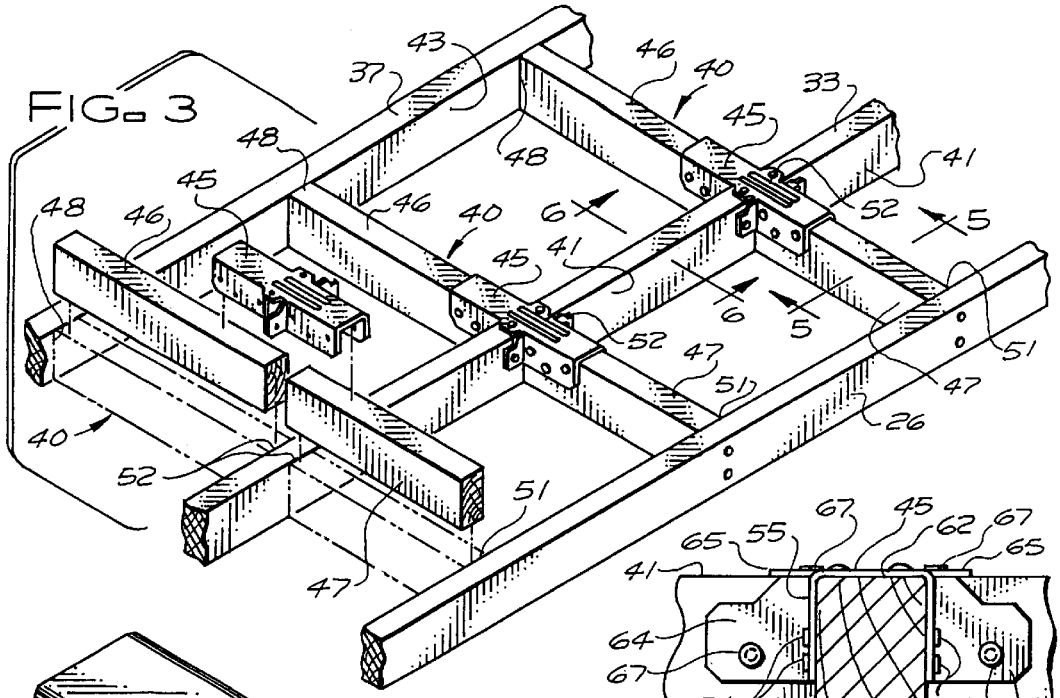
FIG. 3 is a perspective view of system of overhang support for gable roofs according to a preferred embodiment of the present invention utilizing a preferred embodiment of a unitary connector body, according to the present invention.

As a solution to the problems encountered with the existing art of roof gable overhang construction as discussed with FIGS. 1 and 2, the preferred embodiment of the overhang support system for roof trusses of the present invention, utilizing a novel connecting device, unitary connector body 45, is illustrated in FIG. 3. A portion of a roof 21, including an overhang member 26, gable end truss 33 and first adjacent roof truss 37 are shown in perspective. As hereinafter more particularly described, unitary connector body 45 and its two other longitudinally-supporting members may be sometimes referred to together herein as extended roof support 40, which connects overhang member 26, gable end truss 33, and first adjacent roof truss 37, tieing them together in a structurally sound manner. For purposes of this illustration, all members shown are wood 2×4's (although, as stated, 2×'s may be used). It is noted that, in the system of FIG. 3, the top chord 41 of the gable end truss 33 is a continuous single unitary piece without any notching for the extended roof supports 40.

Each extended roof support 40 in the system of FIG. 3 consists of three components, an intermediate support member 46, an overhang support member 47, and a unitary connector body 45. The intermediate support member 46 is butted to, and nailed to the first adjacent roof truss 37 at the inner joint 48. Likewise, the overhang member 26 is positioned to and nailed to the overhang support member 47 at the outer joint 51. The preferred embodiment of the unitary connector body 45 provides, as illustrated and described herein, connection means for connecting to the unitary connector body 45, the intermediate support member 46, the overhang support member 47, and the gable end truss 33 (at its top chord 41). Each connection of the unitary connector body 45 to these other components is made at each location 52 of the gable end truss 33. The unitary connector body 45 is preferably formed of galvanized coated steel, is shaped to snugly fit and locate the wood components (preferably the "2" edges of the 2× wood components) of the connection at location 52, and further provides holes 66 (see FIG. 4) for nailing locations to retain the components, all as shown and described herein. The completed connection at location 52 is structurally sound, permanent, and provides for a strong and efficient gable overhang support system.

Figure 4:
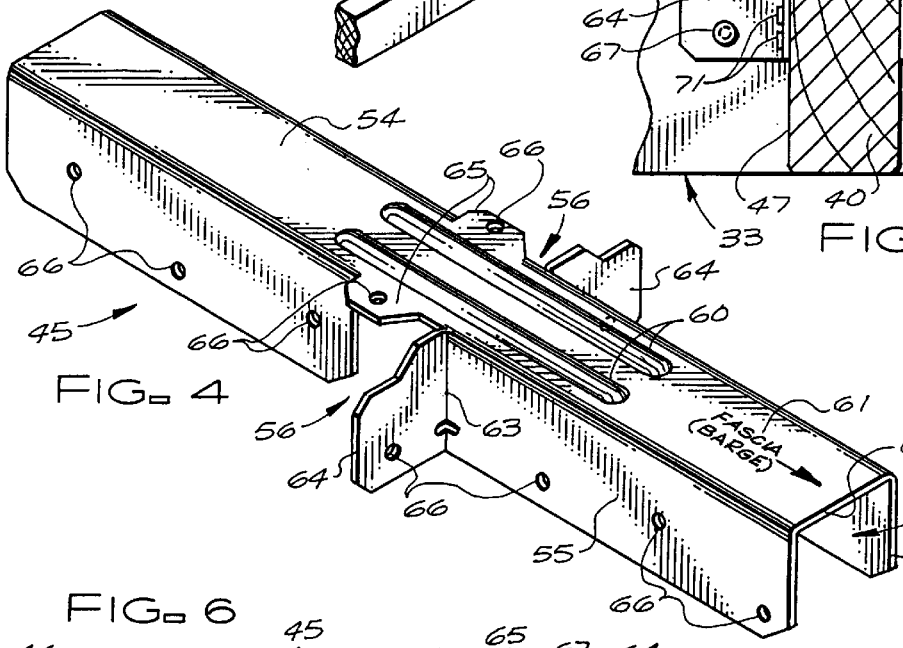
FIG. 4 is a perspective view of the illustrated preferred embodiment of a unitary connector body, according to this invention.

A perspective view of the unitary connector body 45 is shown in FIG. 4. Unitary connector body 45, a channel-shaped member, is preferably stamped and formed of galvanized coated steel of about 18 gage, or thicker, and of the configuration illustrated. The channel 53, providing channel means for fitting snugly over such intermediate support member and such overhang support member, is about 13¾" long and includes a planar longitudinal top horizontal surface 54. Surface 54 in this invention embodies, as shown, a planar portion constructed and arranged for situation adjacent a plane of an upper side of gable end truss top chord member 41 and is elongated in a direction from the connection of unitary connection body 45 to intermediate support member 46 to the body 45 connection with overhang support member 47. Extending downward perpendicular from the longitudinal edges of the horizontal surface 54 are two vertical sides 55 about 1½" in depth. The width between the vertical sides 55, on the interior of the channel 53 is about 1½" to fit snugly over the narrow "2" dimension of a 2×4 or other 2× size. About midway along the length of the unitary connector body 45, on each vertical side 55, is an opening 56, about 1½" wide, and extending from the top horizontal surface 54 downward vertically the full height of the vertical sides 55. The two openings 56 are located exactly opposite each other, (once again, sized to fit snugly over top chord 41, the narrow dimension of a 2×4 or other 2× size).

Two longitudinal ribs 60 rise, about centrally, as illustrated, from the elongated planar portion embodied by top horizontal surface 54, to strengthen the channel 53 against downward bending through the area weakened by the openings 56 on the vertical sides 55. Thus, ribs 60 embody strengthening means for enhancing the structural support against bending of such planar portion of such unitary connector body. One end of the channel 53 is stamped with indicia 61, identifying that end as the fascia (barge) end 62. At each opening 56 on the vertical sides 55, the greater portion of the material from each opening 56 is bent outward at 90 degrees on a vertical bend line 63, on the side of each opening 56 nearest the indica 61 to form a nailing wing 64, which is also useful for positioning and cantilever-support assistance, and thus embodies in this invention a first connector positioning means for abutting gable end truss top chord member 41 for providing enhanced cantilever support for overhang support member 47. A minor portion of the material from each opening 56 extends outward (unbent) from each side of the top horizontal surface 54, above the opening 56, and forms a nailing wing 65. At one location on each nailing wing 64 and each nailing wing 65 and at six locations on each vertical side 55 are nailing holes 66, embodying in the present invention hole means in unitary connector body 45 for receiving attaching units (embodied herein by nails 67). All 90-degree corners of the unitary connector body 45 are slightly trimmed off at 45 degrees, as shown, to remove sharp damaging metal corners.

Figure 5:
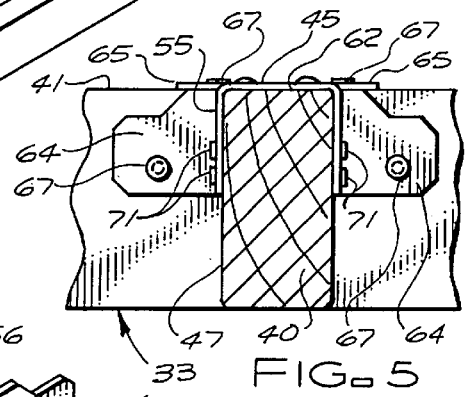
FIG. 5 is a cross-section elevation end view of a roof portion with the illustrated unitary connector body.
Figure 6:
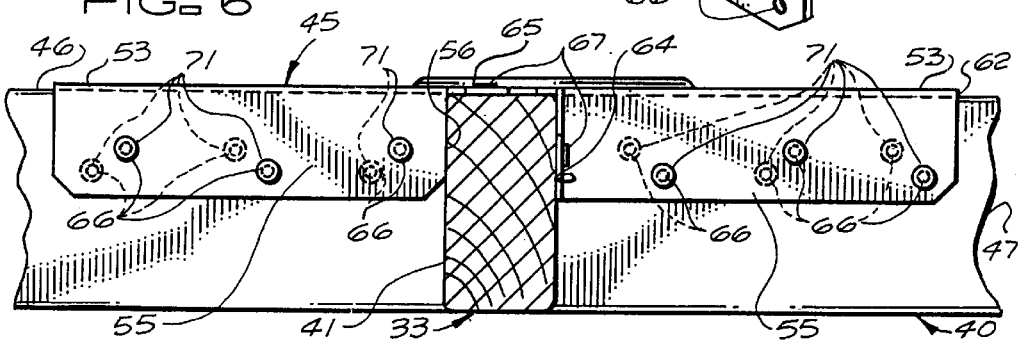
FIG. 6 is a cross-section elevation side view of a roof portion with the illustrated unitary connector body.

The use of the features of the unitary connector body 45 and the overhang support system of the present invention are further described as illustrated in FIGS. 5–7. FIG. 5, which is a view through the section 5—5 of FIG. 3, is an elevation end view of the unitary connector body 45 from the fascia (barge) end 62. The unitary connector body 45 is installed on top of the top chord 41 of the gable end truss 33 with the longitudinal run of the channel 53 perpendicular to the longitudinal run of the top chord 41 within the openings 56 (not shown) of the vertical sides 55. The nailing wings 65 are nailed to the top of the top chord 41, and the nailing wings 64 are nailed to the front of the top chord 41 with nails 67, all as shown in the drawings. The overhang support member 47 of the extended roof support 40 is inserted into the fascia (barge end) 62 of the channel 53 of the unitary connector body 45 and positioned tightly against the top chord 41 and then secured into the channel 53 with nails 71. Likewise, although not shown in this view, the intermediate support member 46 of the extended roof support 40 is installed at the opposite end of the unitary connector body 45. Thus, the present invention provides a method of providing improved support to an overhang support member 47 extending outward from a gable end truss top chord member 41 to support an overhang member 26, comprising the steps of: attaching an intermediate support member 46 between such gable end truss top chord member 41 and the first adjacent truss top chord member 43; attaching such intermediate support member 46 and such gable end truss top chord member 41 to a rigid unitary connector body 45; attaching such overhang support member 47 to such rigid unitary connector body 45 and abutting such gable end truss top chord member 41; and attaching such overhang member 26 to such overhang support member 47; such rigid unitary connector body 45 being constructed and arranged to enhance the strength of cantilever support of such overhang support member 47. And it provides improved wind-uplift support.

FIG. 6, which is a view through the section 6—6 of FIG. 3, shows a side elevation view of the unitary connector body 45 joining the intermediate support member 46 and overhang support member 47 to the top chord 41 of the gable end truss 33. The openings 56 in the vertical sides 55 fit over the top chord 41 with nails 67 through nailing wings 64 and nailing wings 65 securing the unitary connector body 45 in place. Intermediate support member 46 and overhang support member 47 are fitted into the channel 53 of the unitary connector body 45 until tight against the top chord 41, and secured with nails 71. Nailing holes 66 through each vertical side 55 of unitary connector body 45 are staggered, as shown, to prevent the nails entering each side of the intermediate support member 46 and overhang support member 47 from splitting the wood, thereby embodying offset means for providing nailing locations for minimizing structural harm to intermediate support member 46 and overhang support member 47.

In FIG. 7 is shown a top plan view of the connection location 52, with intermediate support member 46 and overhang support member 47 of extended roof support 40 secured at 90 degrees to the top chord 41 of gable end truss 33 with unitary connector body 45. Ribs 60 on the top horizontal surface 54 of the unitary connector body 45 provide added rigidity against bending through the location 52. Nailing wings 64 are located on the front side of the gable end truss 33, facing the direction of the fascia.

FIG. 8 is a plan view of the unitary connector body 45 in its flat form during its preferred method of manufacture, in well known ways, after all shearing, notching, punching and stamping, but prior to bending into its final shape. Dotted lines represent bend lines 63 where nailing wings 64 will be bent upward 90 degrees. Bend lines 72 show locations of downward 90-degree bending of the sides which will form the described channel shape. Thus, it is seen that unitary connector body 45 comprises: first connection means (embodied by, e.g., the specific nail-hole 66 connections structures, etc., of FIGS. 3 and 6) for connecting intermediate support member 46, situated between first adjacent truss top chord member 43 and gable end truss top chord member 41, to unitary connector body 45; second connection means (embodied by, e.g., the specific nail-hole 66 connections structures, etc., as shown in FIGS. 3 and 6) for connecting overhang support member 47, situated between gable end truss top chord member 41 and overhang member 26, to unitary connector body 45; and third connection means (embodied by, e.g., the specific nail-hole 66 connections structures, etc., of FIGS. 3 and 6) for connecting gable end truss top chord member 41 to unitary connector body 45; unitary connector body 45 being constructed and arranged to enhance, when connected, the strength of cantilever support of overhang support member 47, as well as enhancing uplift support.

FIGS. 9 and 10 illustrate an alternate construction of the preferred embodiment of the unitary connector body 45. In FIG. 9, a top plan view of a portion of the unitary connector body 45 is shown prior to bending into its final shape. An additional small tab 73 is incorporated at each opening 56 in the vertical sides 55. At bend lines 74, the tabs 73 are bent upward 90 degrees the same as nailing wings 64 are bent upward at 90 degrees at bend lines 63. In FIG. 10, a perspective view illustrates the central portion of the unitary connector body 45 incorporating the small tabs 73. The spacing between the inside facing surfaces of nailing wings 64 and tabs 73 is about 1½", providing for a close fit to the 2× of the gable end truss 33. Tabs 73 provide for a flat surface contact to the gable end truss 33, thus preventing any possible cutting into the wood and resulting loosening of the location 52. In this invention, tabs 73 also embody a second connector positioning means for abutting gable end truss top chord member 41 for providing positioning support for unitary connector body 45.

FIG. 11 is a perspective view of a connection location 52 of an intermediate support member 46 and an overhang support member 47 to the top chord 41 of a gable end truss 33, using horizontal 2×4's for the intermediate support member 46 and overhang support member 47. This connection utilizes an alternate embodiment 77 of unitary connector body 45 which allows for members 46 and 47 to be installed horizontally. The channel 53 of unitary connector body 45 is about 3½ inches wide for mating to the horizontally-installed 2×4 members. An oblong hole 78 is incorporated near each end of the top horizontal surface 54 to allow nailing of the final plywood panels 25 (not shown) to the extended roof support 40 in the area of the unitary connector body 45. To illustrate the use of a unitary connector body 45 to make up a connection location 52 as compared to the notching used with the prior art method shown in FIG. 2, a notch 42 is shown by dotted lines.

FIG. 12 shows the connection location 52 in elevation view through the section 12—12 of FIG. 11. Nails 71 through the vertical sides 55 of the unitary connector body 45 of the alternate embodiment 77 may be placed in line with each other as the wider channel 53 usually prevents splitting of the wood.

FIG. 13 is a plan view of the unitary connector body 45 of the alternate embodiment 77 in its flat form after all shearing, notching, punching, and stamping, but prior to bending into its final shape. An additional reinforcing rib 60 (compared to the embodiment of FIG. 3) is utilized due to the increased width of the top horizontal surface 54. Oblong holes 78, as mentioned, are provided to allow nailing of the final plywood panels 25. Also, due to the increased width of the top horizontal surface 54, nailing holes 66 are incorporated on the top horizontal surface 54 and additional nailing wings are not required.

Figure 14:
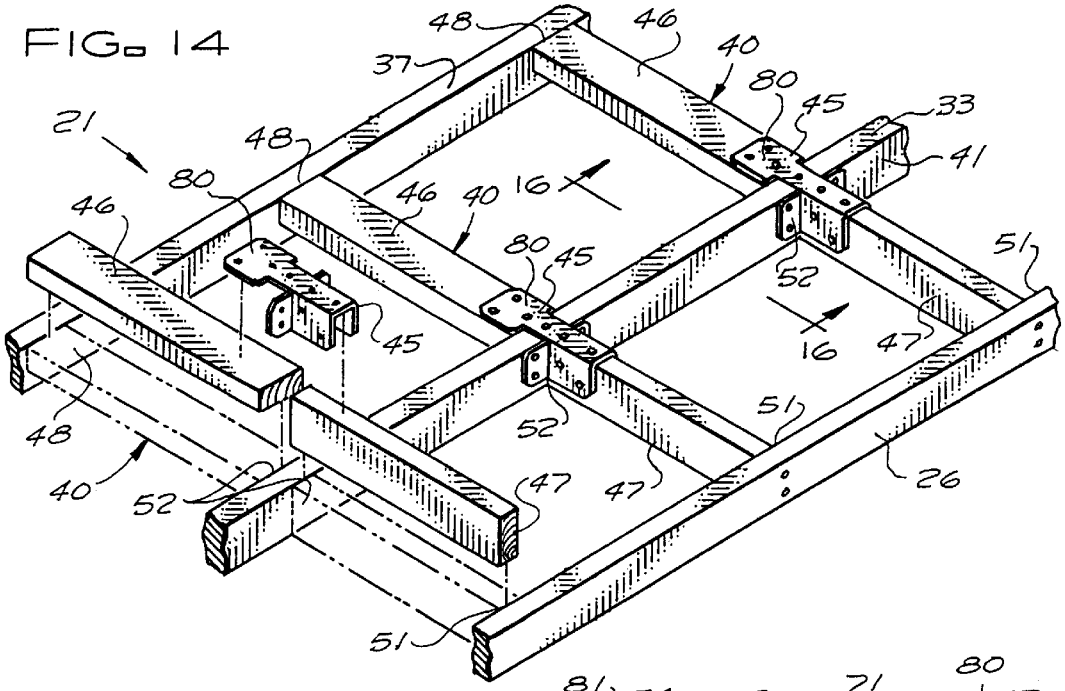
FIG. 14 is a perspective view of system of overhang support for gable roofs utilizing the third alternate preferred embodiment of the unitary connector body of this invention.

Illustrated in FIG. 14 is a perspective view of a portion of roof 21, showing the overhang member 26, the gable end truss 33, and the first adjacent roof truss 37, with these members being structurally tied together with extended roof supports 40. An alternate method of construction is utilized with the incorporation of the third alternate embodiment 80 of the unitary connector body 45 included within the extended roof supports 40. This unitary connector body 45 provides for the intermediate support member 46, spanning between the first adjacent roof truss 37 and the top chord 41 of the gable end truss 33, to be positioned more-horizontally (as shown in the FIGS., particularly FIG. 14), whereas the overhang support member 47 is positioned on edge more-vertically (as shown in the FIGS., particularly FIG. 14) as it extends outward from the gable end truss 33 to support the overhang member 26. As previously described with prior embodiments, the overhang support member 47 and the top chord 41 of the gable end truss 33, to which the unitary connector body 45 is fitted, are shown as 2×4's, although 2×'s may be used. The intermediate support member 46, oriented more-horizontally, may be of any desired width of lumber, 2×'s, 4×'s, etc. As with prior embodiments, the intermediate support member 46 is butted to and nailed to the first adjacent roof truss 37 at the inner joint 48. Likewise, the overhang member 26 is positioned to and nailed to the overhang support member 47 at the outer joint 51. The third alternate embodiment 80 of the unitary connector body 45 incorporates nailing holes for nailing to the intermediate support member 46, the overhang support member 47, and the top chord 41 of the gable end truss 33 at their interconnection at location 52 of the gable end truss 33. This provides for an efficient and strong joint.

Figure 15:
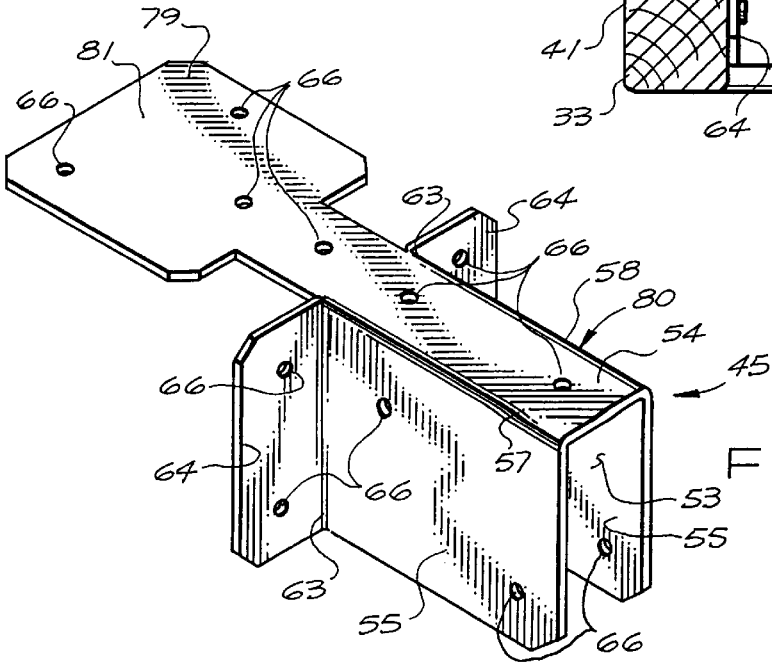
FIG. 15 is a perspective view illustrating the third alternate preferred embodiment of the unitary connector body of this invention.

A perspective view of the third alternate embodiment 80 of the unitary connector body 45 is shown in FIG. 15. The unitary connector body 45 is preferably stamped and formed of galvanized coated steel, with material thickness of approximately 18 gage, or thicker, and of the configuration illustrated. The unitary connector body 45 incorporates a channel 53, providing, in the present embodiment, a first channel means into which the overhang support member 47 may be snugly fitted. Additionally, the unitary connector body 45 incorporates a planar longitudinal top more-horizontal surface 54, as shown, oriented in a longitudinal direction aligned with intermediate support member 46 and overhang support member 47, for mating with the top planar horizontal surfaces of the intermediate support member 46, overhang support member 47, and the top chord 41 of the gable end truss 33, at the location 52 of the joining of these members. Nailing holes 66 through surface 54 provide nailing locations for nailing of the unitary connector body 45 to the top planar more-horizontal surface of the intermediate support member 46, overhang support member 47, and the top chord 41 of the gable end truss 33. Extending downward perpendicular from each of the outward longitudinal edges 57 and 58 of the more-horizontal surface 54 are two more-vertical sides 55, as shown, preferably extending downward about 3¼", and forming channel 53, as shown. This resultant channel 53 is preferably about 4" long and about 1½" in interior width for a snug interface with the narrow "2" dimension of a 2×4 or other 2× size. These preferred increased sizes (over those of other embodiments) also enhance wind-uplift resistance. At the inboard end of each more-vertical side 55 is a nailing wing 64, extending outward at about 90 degrees from each more-vertical side 55, as shown. The two opposing nailing wings 64 form a flat more vertical planar surface, at a right angle to the channel 53, and include nailing holes 66 for secure nailing to the outward face of the gable end truss top chord 41, as shown. The inward portion 81 of the surface 54 is sized to extend inward over the intermediate support member 46 approximately 3¼" and incorporates an increased width, as shown, of about 3¼".

Figure 16:
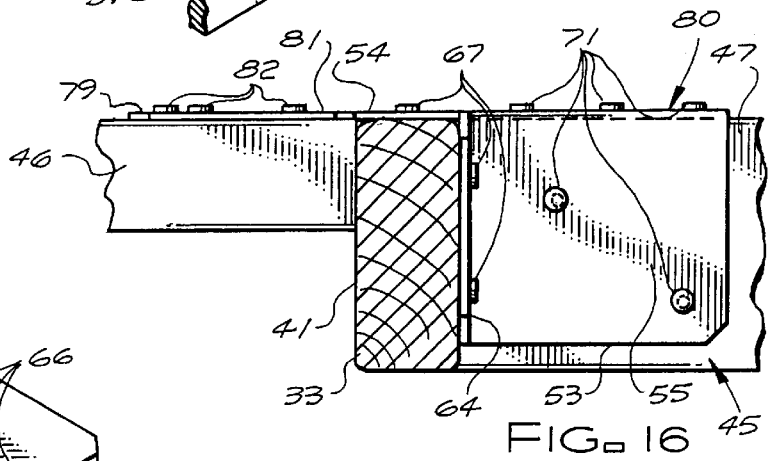
FIG. 16 is a cross-section elevation side view of a roof portion with the illustrated third alternate preferred embodiment of the unitary connector body.

FIG. 16, which is a view through the section 16—16 of FIG. 14, shows a side elevation view of the third alternate embodiment 80 of the unitary connector body 45, joining the intermediate support member 46 and overhang support member 47 to the top chord 41 of the gable end truss 33. The underside of the top surface 54 of the unitary connector body 45 rests atop the top chord 41 with nailing wings 64 contacting the outward more-vertical face of the top chord 41. Nails 67 secure the unitary connector body 45 to the top chord 41. An intermediate support member 46 is fitted to the underside of the extending inward portion 81 of the surface 54, butted against the top chord 41 and nailed in place with nails 82 through the nailing holes 66 of the surface 54. The overhang support member 47 is fitted into the channel 53 of the unitary connector body 45 until tight against the top chord 41, and secured with nails 71 through the nailing holes 66 of the surface 54 and both sides 55.

FIG. 17 is a top plan view of the third alternate embodiment 80 of the unitary connector body 45 in its flat form during manufacture and after all shearing, notching, and punching operations, but prior to bending into its final shape. Bend lines 63, represented by dotted lines, show where nailing wings 64 will be bent upward 90 degrees from the flat form, and result in perpendicularly outwardly extending and opposing nailing wings 64. Bend lines 72 show locations of downward 90 degree bending of the sides 55 which will form the described channel shape. Rend line 83 represents the location of an optional 90 degree bend that is described in FIGS. 18 and 19.

FIGS. 18 and 19 illustrate an alternate form and usage of the third alternate embodiment 80 of the unitary connector body 45. This alternate form may be produced at the time of manufacture of the unitary connector body 45 or it may be accomplished in the field, at the time of usage. As previously described, the third alternate embodiment 80 of the unitary connector body 45 completes the extended roof supports 40 by providing locating and attachment means for securing the intermediate support member 46 and overhang support member 47 to the top chord 41 of the gable end truss 33. With conventional roof framing and roof overhang construction, as described in the prior art of FIG. 1, an overhang support member 47 (or 34) may be used without the added strength benefit of an intermediate support member 46. If the top chord 41 of the gable end truss 33 is rigid, stable and of ample strength to support the overhang member 26 and related weights, the remaining difficulty is providing a worthy attachment of the overhang support member 47 (or 34) to the top chord 41. As previously described, loosening or separation of the nailed connections of the overhang support member 47 (or 34) from the gable end truss 33 could result in structural failure. To provide a strong and permanent attachment of the overhang support member 47 (or 34) to the top chord 41 the third alternate embodiment 80 of the unitary connector body 45, in an altered form, may be used.

In the perspective view of FIG. 18, the alternate form 84 of the third alternate embodiment 80 is shown with the enlarged inward portion 81 of the surface 54 bent downward at about 90 degrees from surface 54, as shown. This bend is located at bend line 83, also shown in FIG. 17. The resulting shape of the unitary connector body 45 provides an opening 56, approximately 1½" wide, for placement of the unitary connector body 45 onto the top chord 41.

The alternate form 84 of the third alternate embodiment 80 of the unitary connector body 45 is shown installed, in the perspective view of FIG. 19. The unitary connector body 45 is nailed to the outward face of the top chord 41 with nails 67 through holes in nailing wings 64 and to the top surface of the top chord 41 with nail 67 through hole in the top surface 54, as previously described. In addition, the unitary connector body 45 is prevented from being pulled from, or loosened from, the top chord 41 with the incorporation of the downward bent inward portion 81 of the surface 54 wrapped and nailed with nails 67 to the inward face of the top chord 41, as shown. When the overhang support member 47 is secured within the channel 53 of the unitary connector body 45, a rigid, permanent joint is obtained. As stated previously, this downward bend of the inward portion 81 of the surface 54 at bend line 83 could be furnished by the manufacturer of the unitary connector body 45, or bent at the job site by the contractor. If bent by the contractor, the bend would be made with a hammer after the connector body 45 has been nailed to the top chord 41 at the top and at the nailing wings 64. Thus, in a preferred embodiment, as described herein, bend line 83 (or the optional bend illustrated), along with inward portion 81 of surface 54 comprises first connection means for use, optionally, by a user, (1) for connecting an intermediate support member, situated between the first adjacent truss top chord member and the gable end truss top chord member, to the unitary connector body, or (2) for connecting the gable end truss top chord member to the unitary connector body. Also, in a preferred embodiment, as described herein and shown herein, the first connection means comprises a substantially-flat bendable portion constructed and arranged in such manner as to provide, when the described/shown bendable portion is not bent, an attachment means for connecting an intermediate support member, situated between the first adjacent truss top chord member and the gable end truss top chord member, to the unitary connector body, and, when such bendable portion is bent, at about 90 degrees, an attachment means for connecting the gable end truss top chord member to the unitary connector body.

Figure 20:
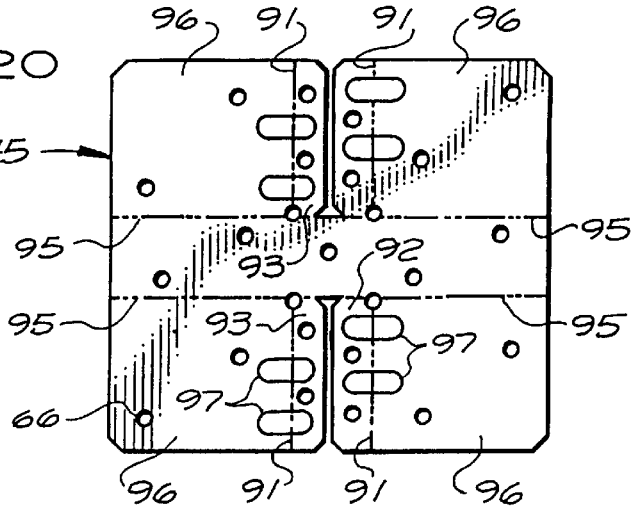
FIG. 20 is a top plan view of the fourth alternate preferred embodiment of the unitary connector body of this invention prior to bending during manufacture.
Figure 21:
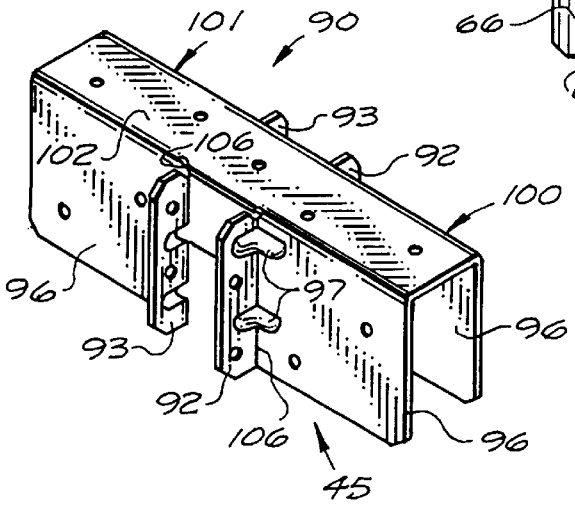
FIG. 21 is a perspective view illustrating the fourth alternate preferred embodiment of the unitary connector body of this invention.
Figure 22:
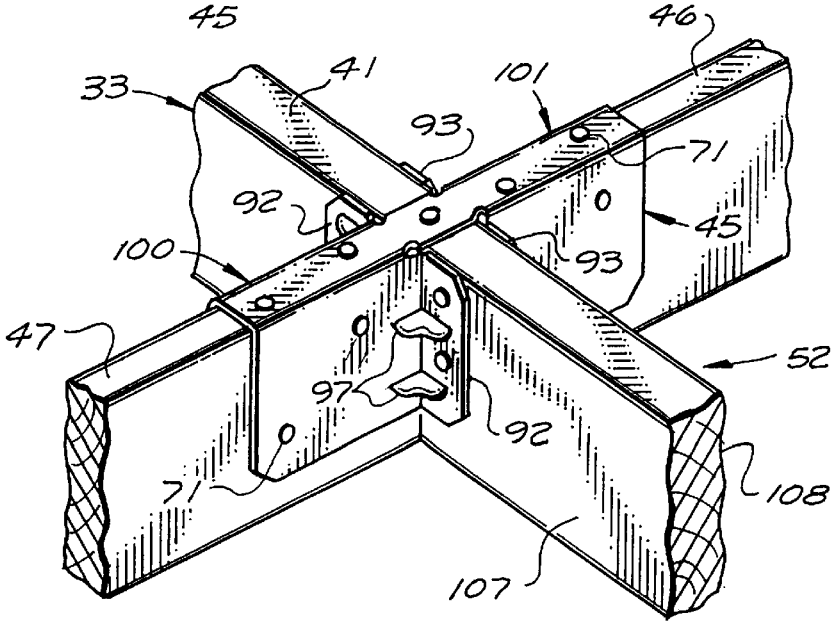
FIG. 22 is a perspective view illustrating the use of the fourth alternate preferred embodiment of the unitary connector body of this invention.

With reference now to FIGS. 20–22, a fourth alternate preferred embodiment of the unitary connector body 45, hereinafter designated by reference numeral 90, will be disclosed. Shown in FIG. 20 is a top plan view of the fourth alternate embodiment 90 of the unitary connector body 45 in its flat form during manufacture and after all shearing, notching, and punching operations, but prior to bending into its final shape. Bend lines 91, represented by dotted lines, show where each of the respective nailing wings 92 and 93 will be bent upward 90 degrees from the flat form, and result in perpendicularly outwardly extending and opposing nailing wings 92 and 93. Bend lines 95 show locations of downward 90 degree bending of the side walls 96 which will form the hereinafter described channel shape. Bisecting bend lines 91 are a plurality of outwardly protruding strengthening ribs 97, formed in accordance with a typical metal forming process, for providing the unitary connector body 45 with enhanced lateral support adjacent bend lines 91 when the unitary connector body 45 is in use. The unitary connector body 45 is also provided with a plurality of nailing holes 66 which are utilized to facilitate attachment of the unitary connector body 45 to the various members comprising the overhang support. As shown, it is preferred that each nailing hole 66 be offset (i.e., staggered to be out of line) from the corresponding nailing hole 66 so as to prevent splitting of the individual wooden members.

FIGS. 21 and 22 illustrate, respectively, a preferred field-ready form and usage of the fourth alternate embodiment 90 of the unitary connector body 45. In a manner substantially as described previously with respect to the aforementioned embodiments, the fourth alternate embodiment 90 of the unitary connector body 45 completes the extended roof supports 40 by providing locating and attachment means for securing the intermediate support member 46 and overhang support member 47 to the top chord 41 of the gable end truss 33 without the need for performing the time-consuming task (and construction-weakening procedure) of notching one or more of the abovementioned members. Shown is a unitary connector body 45 comprising a first channel portion 100 (embodying herein first channel means for fitting snugly over such overhang support member) and a second channel portion 101 (embodying herein second channel means for fitting snugly over such intermediate support member), each preferably having a length of about 4 inches.

Each respective channel portion 100 and 101 comprises two opposing side walls 96 separated by a preferred distance of approximately 1½ inches and extending downward from the planar top portion 102 for a distance of preferably 3¼ inches. To provide enhanced positioning and lateral support, a pair of first nailing wings 92 (embodying herein first connector positioning means for abutting such gable end truss top chord member for providing enhanced cantilever support for such overhang support member) are provided adjacent the inner end 106 of each side wall 96 of the first channel portion 100. Likewise, a pair of second nailing wings 93 (embodying herein second connector positioning means for abutting such gable end truss top chord member for providing positioning support for such unitary connector body) are provided adjacent the inner end 106 of each side wall 96 of the second channel portion 101.

It is preferred that each of the respective pairs of nailing wings 92 and 93 be separated by a preferred distance of approximately 1½ inch so as to provided a snug interface with the "2" dimension of a 2×4 or other "2×" size. As shown, the strengthening ribs 97 preferably are integral to the unitary connector body 45 and extend from each respective nailing wing 92 and 93 to an adjacent side wall 96. The strengthening ribs 97 embody herein side strengthening means, adjoining such first connector positioning means and such second connector positioning means, for enhancing the structural support against lateral bending of such unitary connector body. As used herein, "lateral bending" refers to the tendency of the unitary connector body 45 to bend in the direction of a resultant force applied normal to a side wall 96 when the unitary connector body 45 is incorporated into the roof structure in the manner illustrated and described with respect to FIG. 22.

FIG. 22 is a perspective view of a connection location 52 of an intermediate support member 46 and an overhang support member 47 to the top chord 41 of a gable end truss 33, using 2×4's for the intermediate support member 46 and overhang support member 47. As will be appreciated by those skilled in the relevant art, the unitary connector body 45 comprises a symmetric structure (with respect to both the longitudinal and transverse axis of the unitary connector body 45) in which the first and second channel portion 100 and 101 may be attached to either the intermediate support member 46 or overhang support member 47, therefore providing for quick and simple installation, without possibility of direction confusion by installers. This arrangement embodies herein an arrangement wherein such first and second channel portions 100 and 101 are longitudinally symmetrical and essentially identical in structure; and wherein such first and second pairs of nailing wings are longitudinally symmetrical and essentially identical in structure; whereby such unitary connector body may be situated with either of such longitudinal ends facing such overhang member.

As shown, each respective pair of nailing wings 92 and 93 are structured and arranged for attachment to the adjacent first and second sides 107 and 108, respectively, of the top chord 41 of a gable end truss 33. Attachment of the unitary connector body 45 to the aforementioned members 41, 46, and 47 is by attachment units 71, preferably nails, which are structured and arranged to engage nailing holes 66. In the present embodiment, nailing holes 66 embody a first, second, and third connection means for connecting, respectively, an intermediate support member, situated between such first adjacent truss top chord member and such gable end truss top chord member, to such unitary connector body; an overhang support member, situated between such gable end truss top chord member and such overhang member, to such unitary connector body; and such gable end truss top chord member to such unitary connector body.

Although applicant has described applicant's preferred embodiments of this invention, it will be understood that the broadest scope of this invention includes such modifications as diverse shapes and sizes and materials. Such scope is limited only by the below claims as read in connection with the above specification. Further, many other advantages of applicant's invention will be apparent to those skilled in the art from the above descriptions and the below claims.

What is claimed is:

1. An overhang support system, for a gable roof, comprising:

(a) a gable end truss top chord member;

(b) a first adjacent truss (to said end truss) top chord member;

(c) an overhang member;

(d) an overhang support member, situated between and abutting said gable end truss top chord member and said overhang member; and (e) a unitary connector body comprising:

(i) second connection means for connecting said overhang support member to said unitary connector body; and (ii) third connection means for connecting said gable end truss top chord member to said unitary connector body;

(iii) said unitary connector body being constructed and arranged to enhance, when connected, the strength of cantilever support of said overhang support member.

2. An overhang support system according to claim 1, further comprising:

(a) an intermediate support member, situated between and abutting said first adjacent truss top chord member and said gable end truss top chord member;

(b) wherein said unitary connector body further comprises first connection means for connecting said intermediate support member to said unitary connector body.

3. An overhang support system according to claim 2 wherein said unitary connector body further comprises:

(a) channel means for fitting snugly over said intermediate support member and said overhang support member.

4. An overhang support system according to claim 1 wherein said unitary connector body further comprises:

(a) first connector positioning means abutting said gable end truss top chord member for providing enhanced cantilever support for said overhang support member;

(b) wherein said first connector positioning means abuts a first side of said gable end truss top chord member, said first side facing toward said overhang member.

5. An overhang support system according to claim 4 wherein said unitary connector body further comprises:

(a) second connector positioning means abutting said gable end truss top chord member for providing positioning support for said unitary connector body;

(b) wherein said second connector positioning means abuts a second side of said gable end truss chord member, said second side facing away from said overhang member.

6. An overhang support system according to claim 2 wherein said unitary connector body further comprises:

(a) a planar portion constructed and arranged for situation adjacent a plane of an upper side of said gable end truss top chord member and elongated in a direction from said first connection means to said second connection means;

(b) wherein said elongated planar portion comprises strengthening means for enhancing the structural support against bending of said planar portion of said unitary connector body.

7. An overhang support system according to claim 6 wherein said strengthening means comprises a longitudinal rib raised from said plane.

8. For use with an overhang support system for a gable roof of the type including an overhang member, a unitary gable end truss top chord member, and a first adjacent truss (to said end truss) top chord member, a method of providing improved support to an overhang support member extending outward from said gable end truss top chord member to support said overhang member, comprising the steps of:

(a) attaching said unitary gable end truss top chord member to a rigid unitary connector body;

(b) attaching said overhang support member to said rigid unitary connector body and abutting said gable end truss top chord member; and (c) attaching said overhang member to said overhang support member;

(d) said rigid unitary connector body being constructed and arranged to enhance the strength of cantilever support of said overhang support member.

9. A method according to claim 8 further comprising:

(a) attaching an intermediate support member between said unitary gable end truss top chord member and said first adjacent truss top chord member; and (b) attaching said intermediate support member to said rigid unitary connector body.

10. For use with an overhang support system for a gable roof of the type including a gable end truss top chord member, an overhang support member perpendicular to and, at an abutting end of the overhang support member, abutting the gable end truss top chord member, and a first adjacent truss (to said end truss) top chord member, a unitary connector body comprising:

a. a first channel portion, having a first planar top portion and two first planar side portions, wherein said first channel portion is adapted to be connected, fitting snugly and coaxially with the overhang support member, over the abutting end of the overhang member;

b. an extended co-planar portion of said first planar top portion adapted to be connected to the gable end truss top chord member; and c. at least one nailing wing adapted to be connected to the gable end truss top chord member, wherein said nailing wing is attached to one said first planar side portion side of said first channel portion, and wherein said nailing wing is located in a plane perpendicular both to said first planar side portion of said first channel portion and to said first planar top portion;

d. said unitary connector body being constructed and arranged to enhance, when connected, the strength of cantilever support of said overhang support member.

11. A unitary connector body according to claim 10 further comprising:

a. a second channel portion, having a second planar top portion, co-planar with said first planar top portion, and two second planar side portions, wherein said second channel portion is adapted to be connected, fitting snugly and coaxially with an intermediate support member, to an abutting end of the intermediate support member.

12. A unitary connector body according to claim 11 wherein said extended co-planar portion comprises strengthening means for enhancing the structural support against bending of said planar portion of said unitary connector body.

13. A unitary connector body according to claim 11 wherein said first chanel portion and said second channel portion are each constructed and arranged to fit snugly over the "2" width of a 2× member.

14. A unitary connector body according to claim 11 wherein said at least one nailing wing comprises a. a first pair of nailing wings, one said wing of said first pair being attached to and extending at a right angle from each of said first planar side portions of said first channel, said first pair of nailing wings being structured and arranged for attachment to a first side of the gable end truss top chord member; and b. a second pair of nailing wings, one said wing of said second pair being attached to and extending at a right angle from each of said second planar side portions of said second channel portion, said second pair of nailing wings being structured and arranged for attachment to a second side of the gable end truss top chord member.

15. A unitary connector body according to claim 14 wherein said unitary connector body has longitudinal ends and has a symmetrical structure, and a. wherein said first and second channel portions are longitudinally symmetrical and essentially identical in structure; and b. wherein said first and second pairs of nailing wings are longitudinally symmetrical and essentially identical in structure;

c. whereby said unitary connector body may be situated with either of said longitudinal ends facing the overhang member.

16. A unitary connector body according to claim 10 wherein said extended co-planar portion comprises a bendable portion constructed and arranged in such manner as to provide a. when said bendable portion is not bent, a user option for connecting an intermediate support member, situated between the first adjacent truss top chord member and the gable and truss top chord member, to said unitary connector body, and b. when said bendable portion is bent, at about 90 degrees, a user option for connecting said gable end truss top chord member to said unitary connector body.

17. A unitary connector body according to claim 10 wherein said extended co-planar portion comprises strengthening means for enhancing the structural support against bending of said planar portion of said unitary connector body.

18. A unitary connector body according to claim 10 wherein said first channel portion is constructed and arranged to fit snugly over the "2" width of a 2× member.

* * * * *